United States Patent [19]

Langner et al.

[11] Patent Number: 4,605,205

[45] Date of Patent: Aug. 12, 1986

[54] ARRANGEMENT COMPRISING A GASIFIER AND A DIRECT REDUCTION FURNACE

[75] Inventors: Klaus Langner, Meerbusch-Osterath; Gero Papst, Kaarst; Rolf Hauk, Achern, all of Fed. Rep. of Germany; Michael Nagl, Linz, Austria

[73] Assignees: Korf Engineering GmbH, Dusseldorf, Fed. Rep. of Germany; Voest-Alpine Aktiengesellschaft, Linz, Austria

[21] Appl. No.: 743,640

[22] Filed: Jun. 11, 1985

[30] Foreign Application Priority Data

Jun. 12, 1984 [DE] Fed. Rep. of Germany ..... 3422185

[51] Int. Cl.[4] ..... F27B 9/38

[52] U.S. Cl. ..... 266/160; 266/183; 48/92

[58] Field of Search ..... 75/38; 266/160, 183; 48/92

[56] References Cited

U.S. PATENT DOCUMENTS

| | | | |
|---|---|---|---|
| 2,928,730 | 3/1960 | Luerssen | 75/38 |
| 4,019,895 | 4/1977 | Santen | 75/38 |
| 4,448,402 | 5/1984 | Weber et al. | 266/183 |

FOREIGN PATENT DOCUMENTS

| | | |
|---|---|---|
| 83200642.3 | 11/1983 | European Pat. Off. . |
| 3034539 | 7/1982 | Fed. Rep. of Germany . |
| 2843303 | 12/1982 | Fed. Rep. of Germany . |

*Primary Examiner*—Melvyn J. Andrews

[57] ABSTRACT

In the case of an arrangement comprising a gasifier and a direct reduction shaft furnace positioned above it and which is connected to the gasifier by a connecting shaft, the direct introduction of the reduction gas obtained in the gasifier, even in the case of a high dust proportion, is made possible in that the sponge iron particles are discharged through several radially positioned screw conveyors and the reduction gas is fed to an annular zone formed above the screw conveyors.

17 Claims, 5 Drawing Figures

Figure 1:
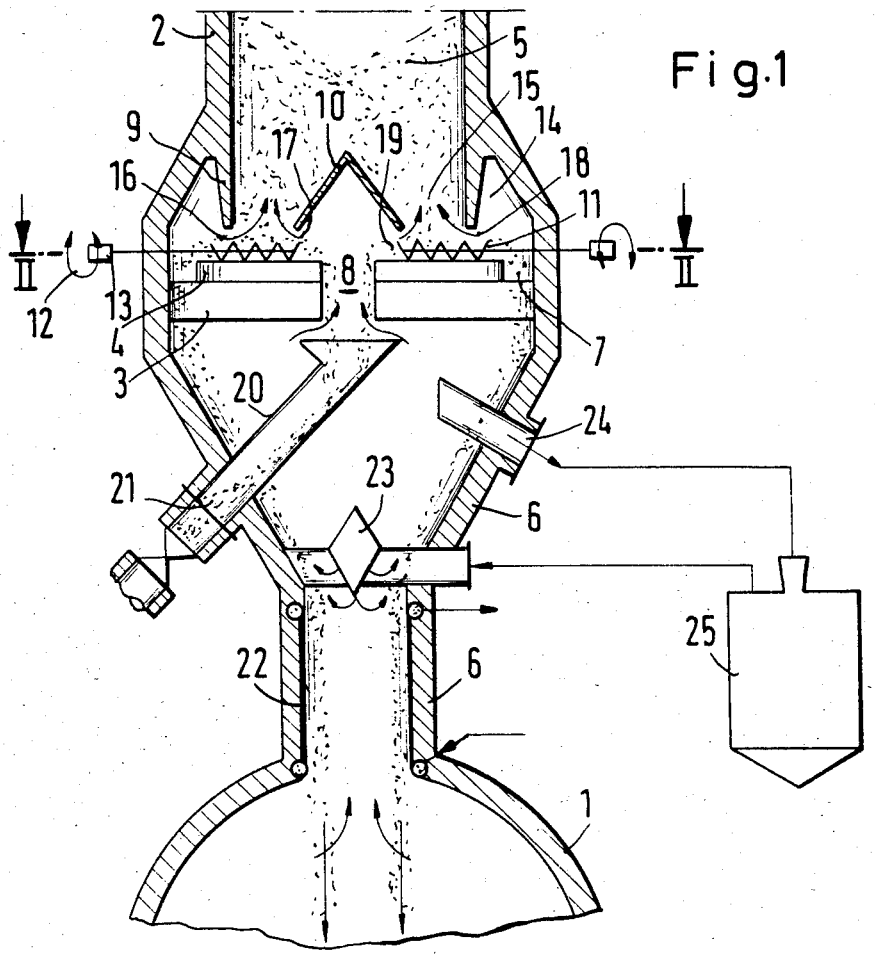

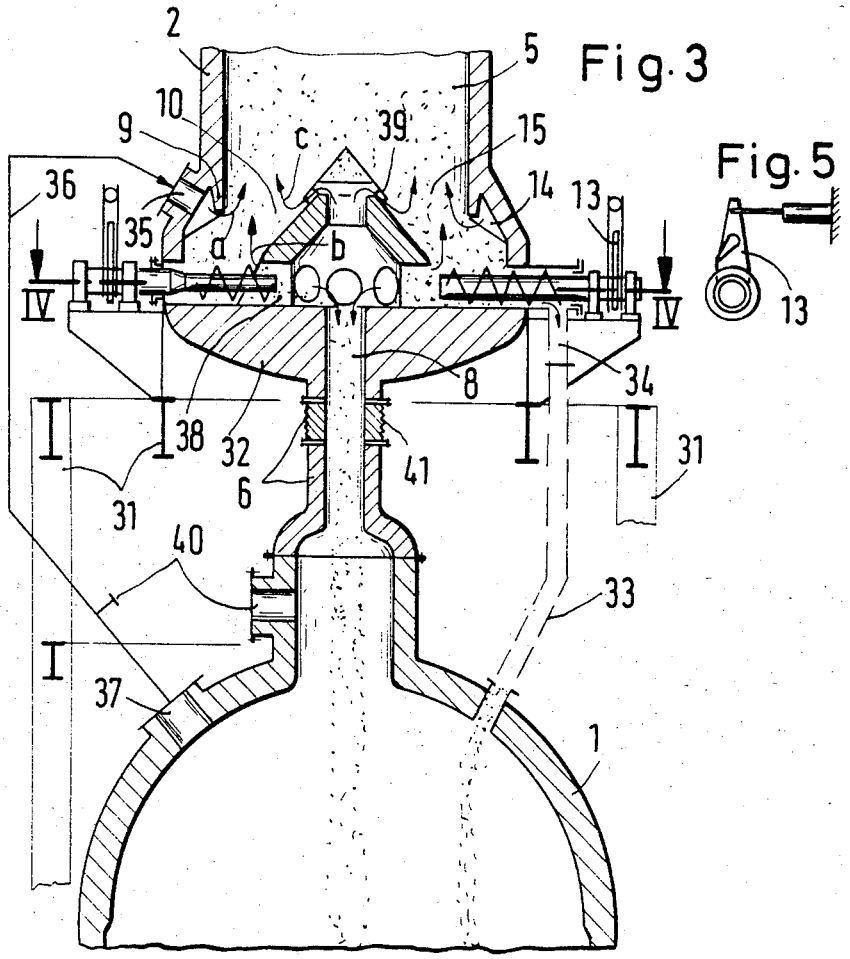
Fig. 3
Fig. 5
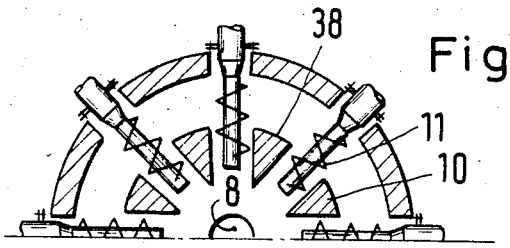
Fig. 4

ARRANGEMENT COMPRISING A GASIFIER AND A DIRECT REDUCTION FURNACE

The invention relates to a direct reduction shaft furnace for reducing iron ore or iron pellets to sponge iron and a gasifier therebelow for supplying reduction gas thereto, and more particularly, to the structure connecting the two for passage of reduced iron particles and reduction gas therebetween.

In the arrangement of this type known from EP-A-1,0094,707, the reduction gas is produced in a melting vessel, in which oxygen and coal dust are blown onto a molten iron bar by means of lances and which acts as a reaction medium and influences the ratio of CO and $CO_2$ in the gas produced. By means of a connecting shaft in which the reduction gas produced is cooled to the necessary reduction gas temperature by coolant blown in, said reduction gas is fed directly into a direct reduction shaft furnace arranged above the melting vessel. Said furnace contains the base in the form of an inverted cone, which supports the charging column in the shaft furnace. The shaft furnace wall is led outwards above the base, accompanied by the formation of an annular clearance. Through the rotation of a spiral slide fitted in the centre of the base, in each case the lowermost sponge iron particle layer can be conveyed via the annular clearance in the connecting shaft to the melting vessel. Simutaneously, the rising reduction gas passes via said annular clearance in to the direct reduction shaft furnace.

The known arrangement presupposes that the dust percentage in the reduction gas introduced via the connecting shaft into the direct reduction shaft furnace is low. A reduction gas with a high dust proportion, e.g. a gas, such as is obtained in a fluidized bed gasifier or in the melting gasifier described in German Pat. No. 2,843,303, would soon lead to a clogging of the gaps in lower area of the charging column by the entrained dust. Thus, in the case of highly dust-laden gas, the reduction gas quantity supplied directly via the sponge iron discharge ports to the direct reduction shaft furnace must be limited to approximately 30% of the total quantity required for the reduction process (German Pat. No. 3,034,539).

The problem of the present invention is therefore to so construct an arrangement that even a gas laden with a higher dust proportion can be supplied in the quantity required for direct reduction directly from the gasifier to the direct reduction shaft furnace, without it leading to the clogging of the gaps in the charging column through the entrained dust, with the resulting non-uniform gas distribution in the furnace and operating faults.

This problem is solved by the present invention.

As a result of the inventive measures, the entrance cross-section of the gas into the charging column is increased and consequently the gas velocity and dust particle pentration depth are decreased.

As a result of the constant increased movement of the sponge iron particles, the necessary permeability to gas, particularly in the penetration zone of the reduction gas into the charge is ensured.

In the case of the claimed arrangement, in the lower area of the charging column, an annular zone is formed, where the sponge iron particles are kept moving by a particularly suitable mechanical device and simultaneously their descent rate is increased. This zone extends from the bottom of the charging column over a large area of the charge and consequently gives the possibility of increasing the intake cross-section for the reduction gas into the charge and therefore, for a given throughput, the flow rate of the gas introduced into the charge, so that the dust particle penetration depth is reduced. When using radially positioned screw conveyor positioned in the charge, the sponge iron particles are continuously drawn out of the annular zone in uniformly peripherally distributed manner and are supplied to the melting gasifier or to the outside. Preferably, the sponge iron particles are discharged from the direct reduction shaft furnace both to the outside via an annular clearance or via downtakes, and to the inside through a central opening in the bottom of the furnace. By means of screw conveyors drivable in both rotation directions, it is possible to control conveying to the outside or inside, as required. For example, at given time intervals, alternately all the screw conveyors can convey to the outside and then to the inside again, or it is possible to provide a sector-like varying conveying with the objective of keeping all the sponge iron particles moving the annular zone and preventing local clogging of the dust entrained by the reduction gas.

Figure 2:
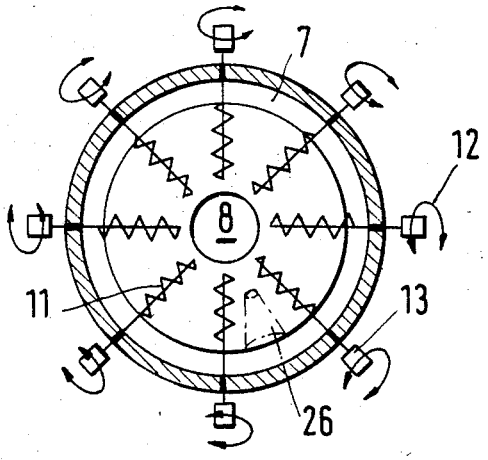

The invention is described in greater detail hereinafter relative to two embodiments and five drawings, wherein diagrammatically show:

FIGS. 1 and 2 a longitudinal section and a cross-section of the part of a first embodiment necessary for explaining the invention.

FIGS. 3 and 4 an identical representation of a second embodiment.

FIG. 5 the drive of the screw conveyors.

FIG. 1 shows in longitudinal sectional form the upper part of the gasifier 1 and the lower part of a direct reduction shaft furnace 2 arranged above it. The furnace contains a base formed by a support structure 3 and a table plate 4 and which serves to support the charging column 5 in the shaft furnace. The upper part of the charging column comprises lumpy iron ore or iron oxide pellets charged from above into the direct reduction shaft furnace, whilst the lower part comprises the sponge iron particles formed therefrom by direct reduction. The furnace is connected by a connecting shaft 6 to gasifier 1.

The base formed by support structure 3 and table plate 4 has an annular clearance 7 and a sponge iron particle discharge port in the form of a central opening 8. In the vicinity of support structure 3, the annular clearance is bridged at the points necessary for fixing said structure. Both discharge ports are shielded against the charging column 5, namely through an annular skirt 9 or a cone 10. By means of a conveying member formed from a plurality of radially positioned screw conveyors 11, the sponge iron particles are churned up and are conveyed from the lower portion of the charging column 5 both to the annular clearance 7 and to the central opening 8. To this end, the screw conveyors can be driven in both rotation directions by individually associated drives 13 and as indicated by the double arrows 12. The radial arrangement of the screw conveyors can be gathered from FIG. 2, which represents the section II—II of FIG. 1.

In this embodiment, there are eight screw conveyors 11 uniformly distributed over the circumference.

In place of the screw conveyors 11, it is also possible to use random other mechanically acting means for vortexing and preferably also transferring the sponge iron particle, e.g. a rotor, a thrust segment, some other driving device, or a vibrating or jolting device.

As is shown in FIG. 1, the annular skirt 9 used for shielding annular clearance 7, as well as the conical insert 10 used for shielding the central opening 8, terminate just above the conveying member formed by the screw conveyors 11. Accompanied by the formation of a natural angle of repose below the edges of the shielding members, the charging column 5 is supported on table plate 4, which must be dismensioned whilst taking account of said angle of repose. An annular space 14 by means of which reduction gas is introduced into the charging column is positioned behind annular skirt 9 and above the natural angle of repose of the charge.

In the case shown in FIG. 1, the inner area of the direct reduction shaft furnace widens downwardly outside the upper end of the annular skirt and the inside of the latter is aligned with the inside of the overlying wall portion of furnace 2. The furnace wall could also be constructed without widening in the vicinity of the base, if the annular skirt was led conically inwards.

Advantageously, the passage cross-section for the sponge iron particles is shaped into an annular zone in the adjacent area above the conveying member and to it the hot reduction gas from the gasifier 1 can be supplied in a uniformly distributed manner over the periphery. In the present case, annular zone 15 is only formed by the conical insert 10 and the hot reduction gas, as indicated by arrows 16 and 17, is introduced through the annular gas intake areas 18, 19 into charging column 5 so as to be uniformly distributed over the periphery. Thus, the hot dust-laden reduction gas passes via a large entry cross-section into an area of charging column 5, in which the sponge iron particles are kept permanently moving by the screw conveyors 11 and at a higher passage speed compared with the higher zone. As stated hereinbefore, even in the case of highly dust-laden air, this further reduces the risk of local clogging of gaps in the charging column and leads to a uniform through-gassing of the direct reduction shaft furnace.

This effect can be aided if the screw conveyors are contructed in the form of a screw flight interrupted by paddles, as is known from German Pat. No. 3,034,539, and if the screw conveyors can be individually driven in both rotation directions, as in the present case.

In the case of the embodiment shown in FIG. 1, the sponge iron particles discharged via annular clearance 7 are supplied by connecting shaft 6 to gasifier 1, which is constructed as a melting gasifier and the sponge iron particles discharged via the central opening 8 are led outwards through a discharge pipe 20, via connection 21. As a result of modified constructions, it is obviously also possible for all the iron particles to be conveyed outwards or into gasifier 1 or, if necessary, random subdividing of the partial flows can take place.

To reduce the temperature of the hot reduction gas obtained in gasifier 1 to that necessary for the direct reduction shaft furnace, in the embodiment according to FIG. 1 there is also indirect cooling by a heat exchanger 22 and direct cooling by admixing cooling gas via a central cooling gas distributor 23. The cooling gas is reduction gas removed by means of a connection 24, which is cooled in a cooling gas scrubber 25 and is then supplied to the cooling gas distributor 23.

The reduction gas produced in gasifier 1 passes via connecting shaft 6, where it is set to the necessary temperature, through the annular clearance 7 or central opening 8 into annular space 14 or the space below the conical insert 10 and from there through the annular gas intake areas 18, 19 into the charging column.

As is shown in FIG. 2, by means of the screw conveyors 11 distributed over the circumference, the sponge iron particles can be led continuously outwards from the bottom portion of charging column 5 to the annular clearance 7 or inwards to the central opening 8. To avoid dead zones there, the screw conveyors can conically taper (not shown) inwards through or towards central opening 8 or, as indicated in broken line form, between adjacent screw conveyors it is possible to have wedges 26, which converge both towards central opening 8 and upwards.

In the second embodiment according to FIGS. 3 to 5, parts corresponding to those of the embodiment according to FIGS 1 and 2 are given the same reference numerals. The second embodiment differs from the first essentially in that the direct reduction shaft furnace 2 arranged over the gasifier is supported on its own support frame 31. The furnace base 32 supporting the charging column 5 only has a central opening 8 as the discharge port for the sponge iron particles, so that the base can be supported in a stable manner without cooling problems. However, it is possible to additionally provide downtake 33, one of which is shown in broken line form, which make it possible to convey the sponge iron from the outer end of the screw conveyors into gasifier 1. For this purpose in the outer area of the screw conveyors, connections 34 are provided in each case and they are in each case connected by a downtake 33 to the inner area of gasifier 1. It is obvious that here again the screw conveyors can be driven in both rotation directions, or a combination of continuously outwardly conveying and continuously inwardly conveying screw conveyors can be provided.

In the case of the second embodiment, once again most of the reduction gas is blown via an annular intake from the periphery into the annular zone 15. This part is designated a. Since throught the omission of the annular clearance 7 of the first embodiment, the reduction gas can no longer take this route into the annular space formed behind annular skirt 9, there is at least one connection 35 issuing into annular space 14 and which is connected via a gas line 36 to a gas outlet 37 or gasifier 1.

In the second embodiment, conical insert 10 has opening 38, in which engage the inner ends of the radially positioned screw conveyors 11. Openings 38 form a gas inlet for the reduction gas rising in gasifier shaft 6 and specifically for the partial flow b. A further partial flow c is introduced through the annular clearance 39 of conical insert 10 into annular zone 15. Furthermore, when downtakes 33 are provided, a partial flow passes via these into the charging column. The partial flow a forms approximately 65% by volume, partial flow b approximately 25% by volume and partial flow c approximately 10% by volume of the hot reduction gas introduced into annular zone 15. As the gas is introduced via a large cross-section, there is a low speed and a limited penetration depth of entrained dust particles, so that the risk of clogging of the gas between the sponge iron pellets, even in the case of a reduction gas with a high dust proportion is further reduced and a uniform gas distribution can be ensured. Cooling gas introduction connections 40 are provided in connecting shaft 6 and gas pipe 36. The connecting shaft also contains a compensating section 41, which compensates height differences with respect to the base 32 carried by structure 31.

The drive 13 shown in FIGS. 3 and 5 is constructed in the form of a pawl and detent switch, two such drives being associated with each screw conveyor 11, if the screw conveyors can be driven in both rotation directions.

We claim:

1. A combined melting gasifier and a direct reduction shaft furnace structure for reducing lumpy iron ore or iron oxide pellets, comprising a base adapted to support a charging column of ore in the shaft furnace, at least one discharge port being formed in the base for discharging sponge iron particles produced by reduction of said ore and at least one annular intake being formed in said shaft furnace to convey the reduction gas supplied by the gasifier to the charge in the lower part of the charging column, and mechanical means disposed at the base of said shaft furnace for causing the continuous reciprocal movement of the reduced charge particles in an area adjacent said annular intake for the reduction gas.

2. A structure according to claim 1, wherein means are provided to distribute the reduction gas in uniform manner over the circumference of the furnace.

3. A structure according to claim 1, wherein means are provided in said shaft furnace to form an annular passage therein for both discharge of sponge iron particles and supply of reduction gas to said charging column.

4. A structure according to one of the claims 1 to 3, wherein the lower end of said furnace is connected by a connecting shaft to said gasifier.

5. A structure according to claim 1, wherein said mechanical means simultaneously serves as a conveying member for conveying sponge iron particles to the discharge port.

6. A structure according to claim 5, wherein said mechanical means is formed by a plurality of radially arranged screw conveyors.

7. A structure according to claim 5, wherein said mechanical means is formed by a thrust segment.

8. A structure according to claim 5, wherein said mechanical means is formed by a vibrating device.

9. A structure according to claim 6, wherein said screw conveyors are constructed in the form of an interrupted screw flight formed by paddles.

10. A structure according to claim 6, wherein wedges are arranged in the peripheral direction between said screw conveyors.

11. A structure according to claim 1, wherein a discharge port for the sponge iron particles is provided in said base in the form of an annular clearance between said base and the inner wall of the direct reduction shaft furnace.

12. A structure according to claim 1, wherein a discharge port for the spong iron particles is provided in the form of a central opening in said base of said direct reduction shaft furnace.

13. A structure according to claim 1, wherein the wall of the direct reduction shaft furnace has an annular depending skirt forming an annular space behind the annular skirt said space being connected to a gas outlet of said gasifier.

14. A structure according to claim 13, wherein the inner area of said direct reduction shaft furnace is downwardly widened outside the upper end of said annular skirt and the inside of said skirt is aligned with the inside of the overlying wall portion of the direct reduction shaft furnace.

15. A structure according to claim 3, wherein said means to form an annular passage is a conical insert forming at least one annular gas intake shielded with respect to the charge and connected to the gasifier.

16. A structure according to claim 6, wherein the inner ends of said radially positioned screw conveyors engage in openings of a conical insert forming a reduction gas intake connected to said gasifier.

17. A sturcture according to claim 6, wherein a sponge iron particle discharge port is connected by a connecting line to said gasifier and to the outer ends of said radially positioned screw converyors.

* * * * *